US005205808A

United States Patent [19]

Gebhardt

[11] Patent Number: 5,205,808

[45] Date of Patent: Apr. 27, 1993

[54] METHOD AND APPARATUS FOR MAKING INTERFOLDED BOXED BAGS

[75] Inventor: Terry D. Gebhardt, Longview, Tex.

[73] Assignee: T C Manufacturing Co. Inc., Evanston, Ill.

[21] Appl. No.: 804,431

[22] Filed: Dec. 10, 1991

[51] Int. Cl.[5] ..... B31B 23/96; B31B 23/98; B31B 23/56; B65H 45/24

[52] U.S. Cl. ..... 493/194; 493/204; 493/359

[58] Field of Search ..... 493/194, 197, 203, 204, 493/208, 357, 358, 359

[56] References Cited

U.S. PATENT DOCUMENTS

| | | | |
|---|---|---|---|
| 3,229,974 | 1/1966 | Banks | 493/359 |
| 4,023,470 | 5/1977 | van der Meulen | 493/194 |
| 4,046,257 | 9/1977 | Lemacher | 493/203 |
| 4,526,565 | 7/1985 | Hummel et al. | 493/196 |
| 4,637,812 | 1/1987 | Ogawa | 493/357 |
| 5,000,729 | 3/1991 | Yamauchi | 493/359 |
| 5,050,742 | 9/1991 | Muckenfuhs | 206/610 |
| 5,065,868 | 11/1991 | Cornelissen e al. | 206/494 |

*Primary Examiner*—William E. Terrell
*Attorney, Agent, or Firm*—Lee, Mann, Smith, McWilliams, Sweeney & Ohlson

[57] ABSTRACT

An interfolded boxed bag arrangement and method and apparatus for making the same from plastic tube or sheeting stock. Plastic tubular or sheeting stock is unwound off two rolls under tension. The stock proceeds to various stations where it is cut into bag lanes by rotary knife blades. A bag lane is cut between each pair of rotary knife blades with a hot knife to form a sealed bottom for the bags. The bag lanes are then cut to a specified length with a hot knife which seals each side of the bag. Bags produced by each roll of stock material are staggered adjacent to one another and are interfolded with each other by a set of rotary gripper fingers and tucker fingers to form an interfolded stack of bags. The stacks are placed into a dispensing box for individual dispensing.

6 Claims, 5 Drawing Sheets

METHOD AND APPARATUS FOR MAKING INTERFOLDED BOXED BAGS

BACKGROUND OF THE INVENTION

Plastic bags in various sizes and shapes are useful in numerous different commercial enterprises, for example grocery stores, fast food restaurants, hardware stores and related outlets. These bags are normally supplied in a number of different configurations but principally they are in some sort of a bag pad which sometimes uses a bag dispenser. For example, see U.S. Pat. No. 4,487,381 entitled Bag Dispensing Device which discloses a bag dispensing package including a stack of flat bags, U.S. Pat. No. 4,790,803 which discloses a bag pad concerned with bagging a pair of liquid containers, and U.S. Pat. No. 4,932,560 which discloses a bag pad and dispenser. All of these patents are assigned to T C Manufacturing Company, Inc. of Evanston, Ill., the assignee of this application. This approach to providing plastic bags for commercial uses is perfectly satisfactory but there may be occasions where a different method of dispensing the bags would be more desirable.

Facial tissues have been dispensed from boxes for many, many years. A box of tissues can be placed wherever it is desirable near the area of their use. The same is true of plastic separation sheets or things of that nature which are used in the food dispensing industry. It is often desirable that such a box would be useful for dispensing plastic bags. In the past such bag dispensing arrangements have dispensed a single bag or torn only a single bag from a roll within the package but without providing an easy access to the next sequential bag. This has been the case because of difficulty in handling plastic, for example polyethylene, bags and packaging a number of them in an interfolded relationship such that the removal of one bag will pull the next bag to an available position.

SUMMARY OF THE INVENTION

An interfolded box bag arrangement and method and apparatus for making the same from tube or sheeting stock is disclosed. These products are useful for bagging various style goods that are available at consumer outlets. The bag consists of two panels extending between side and end seals that extend normally of the bag bottom. As incorporated in the preferred embodiment disclosed herein, the bag has a back panel which includes a projecting flange that extends beyond the top edging of the front panel which is free of the back panel to allow for easy access and opening for the loading of the various products. The bags are tucked together so as to form an interfolded arrangement. Each side end seal is tucked into a fold that extends normally of the bag bottom at the approximate midpoint of the proceeding bag. The interfolded bag arrangement allows the bags to dispense from a box one at a time, leaving a side end seal edge exposed at the opening of the box. Thus, the bags may be withdrawn one at a time from the box at consumer outlets to bag the usual products at the point of sale and the next succeeding bag is always available at the aperture in the box.

The method and apparatus disclosed effects formation from web or tube stock of such bags in units consisting of single or multi-lane production. The method of making the boxed interfolded bags starts from tubular or sheeting roll stock which is unwound off a dual unwind stand under uniform tension. The stock proceeds over idler rolls to various stations such as the trim pulling station wherein the top panel of the tube is cut in machine direction to form a loose strip of specified width. The strip is pulled away from the tube at some angle and wound on a roll for an appropriate trim disposal. This station is only needed if tubular stock is used.

The next station is the knife bag separation station which separates the bag lanes at the open end of the bag forming a lip on each of the two bags simultaneously. This is accomplished by using a rotary knife blade or other appropriate method. There could be multiple units at this station in accordance with the number of lanes required.

The next station is the slit seal station which forms the seal bottom of two bags and also separates them forming additional lanes. A hot knife or other appropriate device is used to create a seal in the machine direction.

The next station is the timed cut and seal station which cuts the stock lanes to a specified length which forms the width of the bag. This station consists of two units each cutting one incoming sheet or tube of stock. This is accomplished by way of a rotary hot knife or other appropriate device. The film or stock is held by a vacuum drum device while cut and until it is through the interfolding station. At the interfolding station the specified length cut bag is stripped from the vacuum drum and transferred to a set of rotary gripper fingers and tucker fingers. These devices are timed so as to form a stack of interfolded bags, i.e. one tucked and folded approximately one-half the length of itself with relationship to the next bag. From this last stage or station, the stacks are automatically preset to a specified count and put into a dispensing box. These bags resemble facial tissues in a box and dispense one at a time by pulling the leading edge of the next bag out ready for use. Such construction is extremely convenient for many commercial outlets and the boxes are readily combinable into commercial sized packaging for shipping and handling.

DETAILED DESCRIPTION OF THE PREFERRED EMBODIMENT

Figure 1:
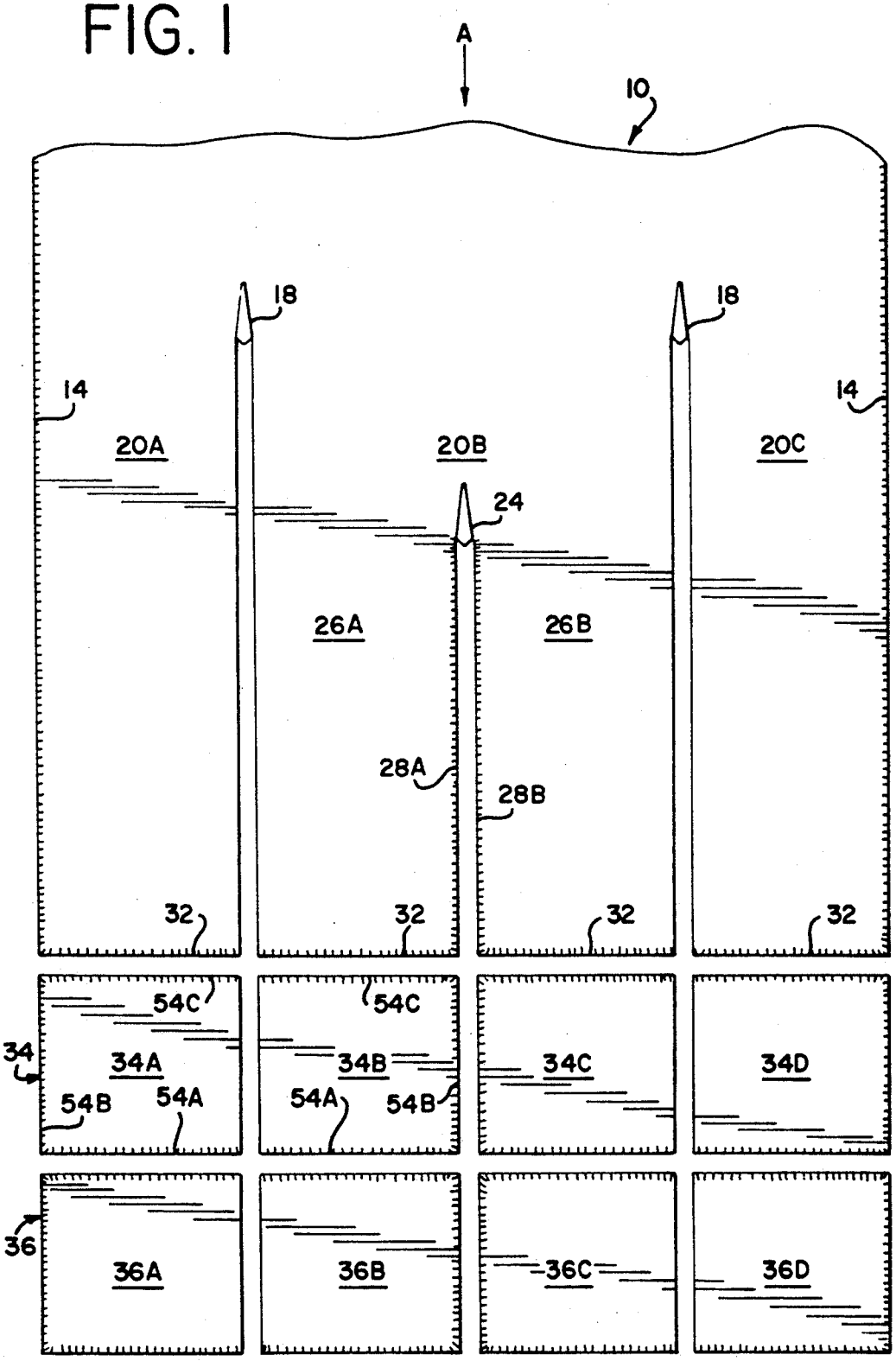
FIG. 1 is a partial flow diagram showing the cut and seal operations used for producing the interfolded bags of this invention.

In FIG. 1, which is a partial flow diagram, there is shown tube stock 10 which is moving in the direction of the arrow A in the apparatus for making the interfolded box bag arrangement. The tube stock 10 comes off of rolls of tubular roll stock 12 (see FIG. 2) and is therefor sealed at the sides 14. The tube stock 10 moves through the knife bag separation station 16 (see FIG. 2) where it is cut 18 to provide separate lanes 20A, 20B and 20C. There may be any number of lanes depending upon the width of the tube stock 10 and the number of knives in the knife bag separation station 16. The tube stock 10 moves through the slit seal head assembly 22 wherein it is cut at 24 which divides the lane 20B into two additional lanes 26A and 26B and sealed simultaneously at the sides 28A and 28B. This operation has now provided for similar bag lanes. The tube stock 10 moves through the timed cut and seal station 30 (see FIG. 2) which cuts the stock lanes at 32 to a specified width which forms the width of the bag. This station also seals the bag at 32 so that there is now provided separate discrete bags 34A, 34B, 34C and 34D which are sealed on three sides and have an open top. Further shown in FIG. 1 is the preceding set of bags indicated at 36 which are also sealed on three sides and have an open top. The bags 34 and 36 will then be interfolded in the interfolding station 38.

Figure 2:
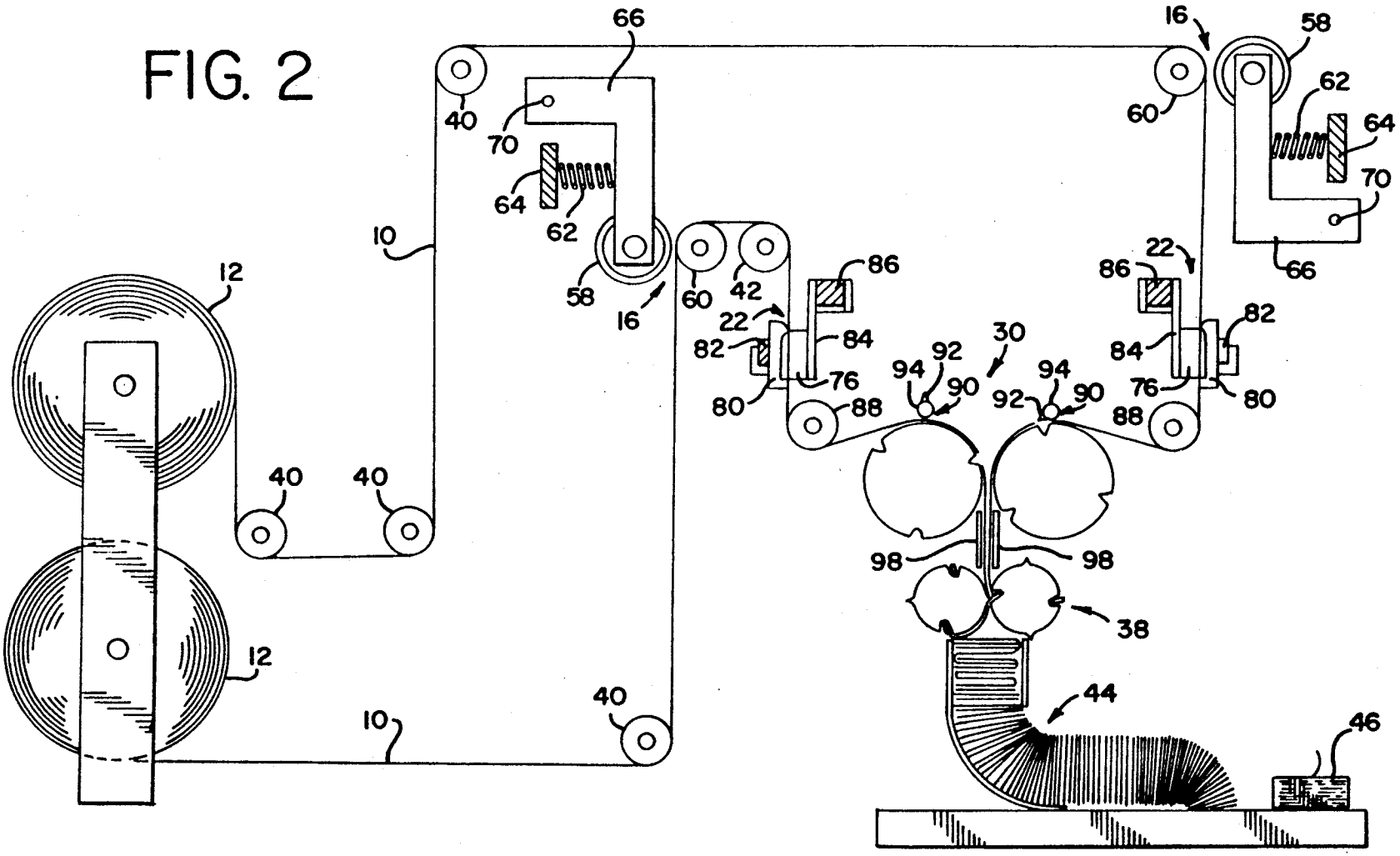
FIG. 2 is a diagrammatic view showing the various interfolded bag making stations.

Referring now more specifically to FIG. 2, which is a diagrammatic view showing the various interfolded bag making stations, it can be seen that the tubular roll stock in roll form 10 is fed into the device over the idler rollers 40 which operate to keep the roll stock under tension and into the two knife bag separation stations 16 over additional idler rollers 42 and into the slit seal head assembly 22. From there the tube stock proceeds to the timed cut and sealed station 30 and then passes through the interfolding bag station 38. From this last stage or station, the interfolded bags are automatically stacked to a preset specified count as shown at 44 and put into a dispensing box 46. The construction of the various stations will be more specifically described hereafter but first the bag and the box will be described.

Figure 4:
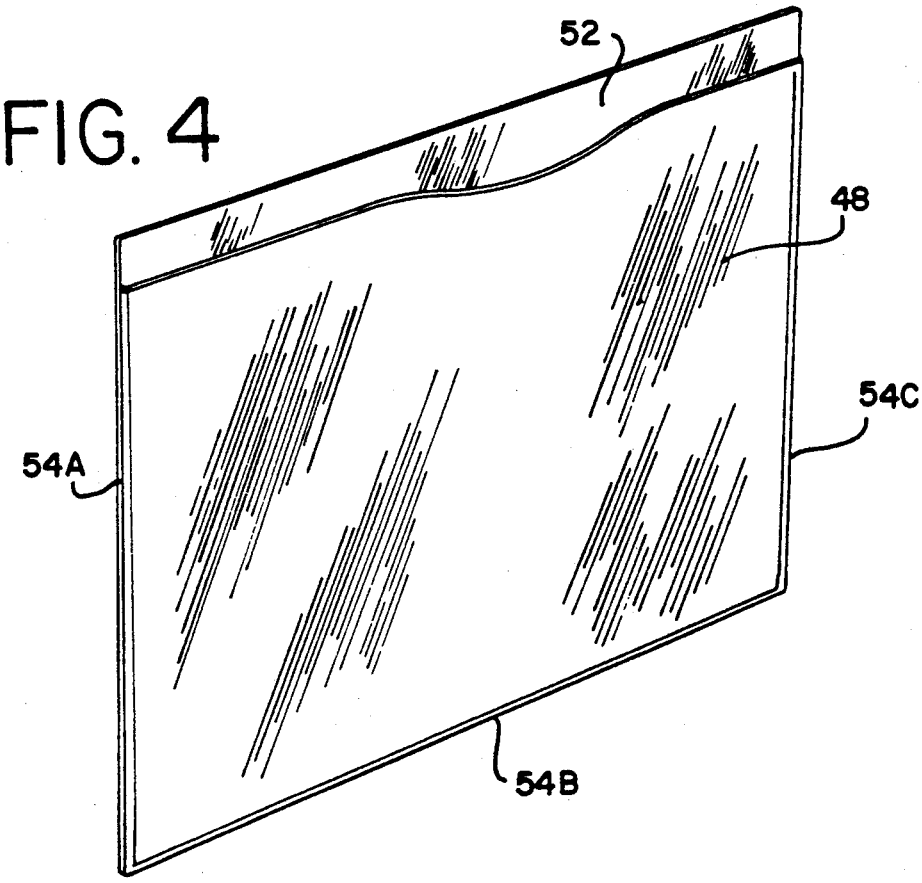
FIG. 4 is a perspective view of one type of bag.

Calling attention to FIG. 4, there is shown a perspective view of one type of bag 48 that can be interfolded and packaged in accordance with the disclosure of this invention. As can be seen in FIG. 4, the bag comprises a front wall 50 with a back wall therebehind (not shown) having a lip 52 which is part of the back wall. The bag is sealed on three sides at 54A, 54B and 54C. Such a bag can easily be opened by means of the lip 52 to insert articles therein.

Figure 3:
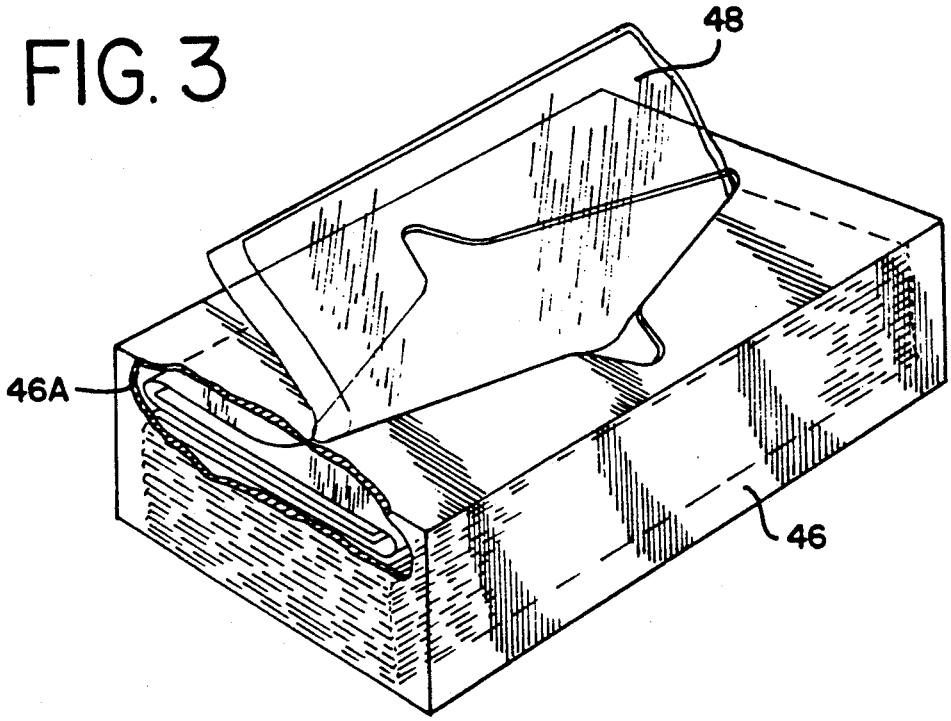
FIG. 3 is a perspective view partially broken away to show the interior arrangement of a box of interfolded bags.

FIG. 3 is a perspective view, partially broken away, of the boxed interfolded bags. The box 46 itself is of conventional construction having an opening 56 through which the bags may be dispensed. The shape of the opening 56 may be varied as desired depending upon the weight of the plastic film that is used in the construction of the bag 48. Through the broken away section 46A of the box, there can be seen the interfolded bags 48 located therein with the bags tucked and folded together so that approximately one half the length of a bag is folded over to receive the next bag. Thus on the removal of one bag from the box, the next bag 48 will be pulled partially out so as to be available for use.

Figure 7:
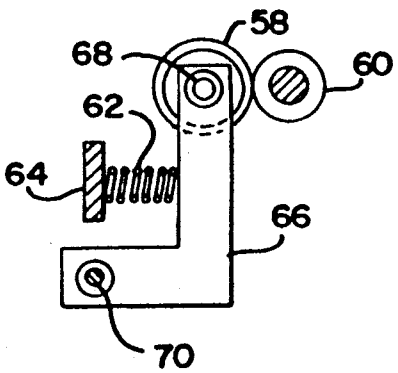
FIG. 7 is a view taken substantially along the line 7—7 of FIG. 6.
Figure 6:
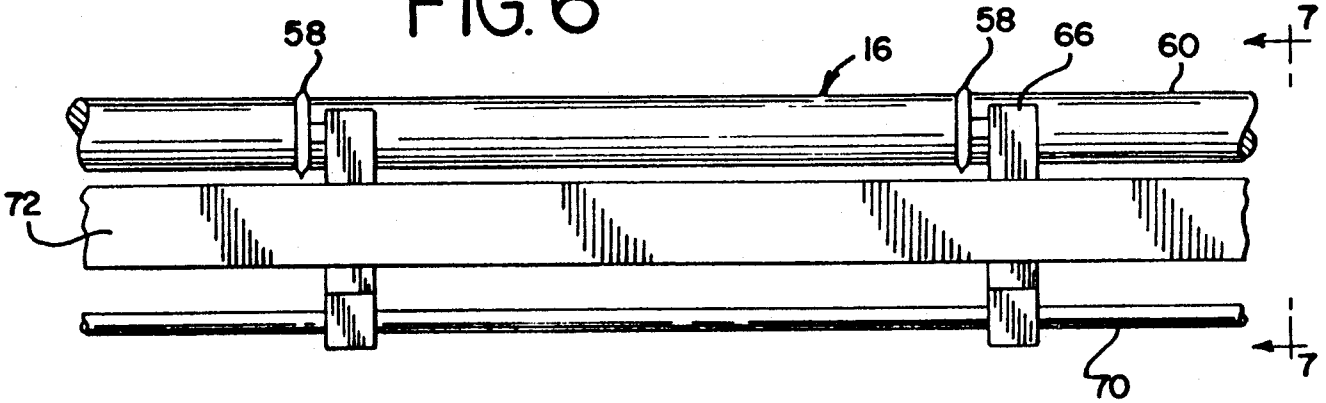
FIG. 6 is a partial frontal view of the knife bag separation station.

Referring now to the various stations shown in FIG. 2, the knife bag separation station which is shown in FIGS. 6 and 7 includes a rotating knife 58 which abuts a rotating hardened knife backup roll 60. The tension of the rotating knife 58 against the back up roll 60 may be adjusted by means of the spring 62 which is compressed by the bolt 64 (shown diagrammatically). The rotating knife is held by a bracket 66 wherein it rotates on its axle 68. The bracket 66 is held in place by the knife support rods 70 which together with the side plate mounting bars 72 and the back up roll 60 are supported in a frame (not shown) of the interfolded bag making device. There may be additional knives 58 depending upon the number of bag lanes that are desired which, of course, is determined by the width of the sheet or tube material 10.

Figure 9:
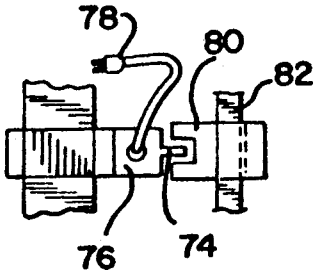
FIG. 9 is a view taken substantially one the line 9—9 of FIG. 8.
Figure 8:
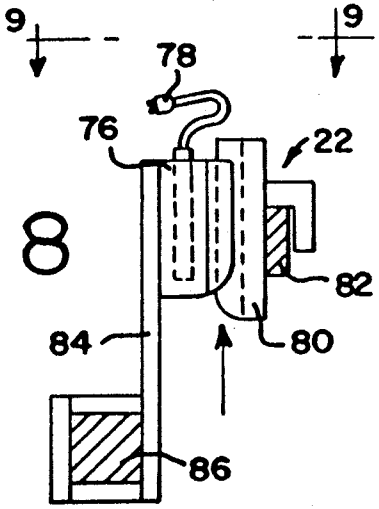
FIG. 8 is a partial side view of the slit seal head assembly.

Next is the slit seal head assembly which is shown more specifically in FIGS. 8 and 9. As previously described, the slit seal station 22 forms the seal bottom 54B of two bags and also separates them forming additional lanes. A hot knife 74 performs this operation. The knife is heated by means of an electrical resistance unit 76 which is connected to a conventional electrical source by a plug 78. The knife 74 operates against the back-up plate 80 which is mounted on a back-up support plate 82 which is mounted in the frame (not shown). The knife 74 is mounted on a bracket 84 which is mounted on a slit seal support bar 86 which is also mounted in the frame (not shown).

Figure 5:
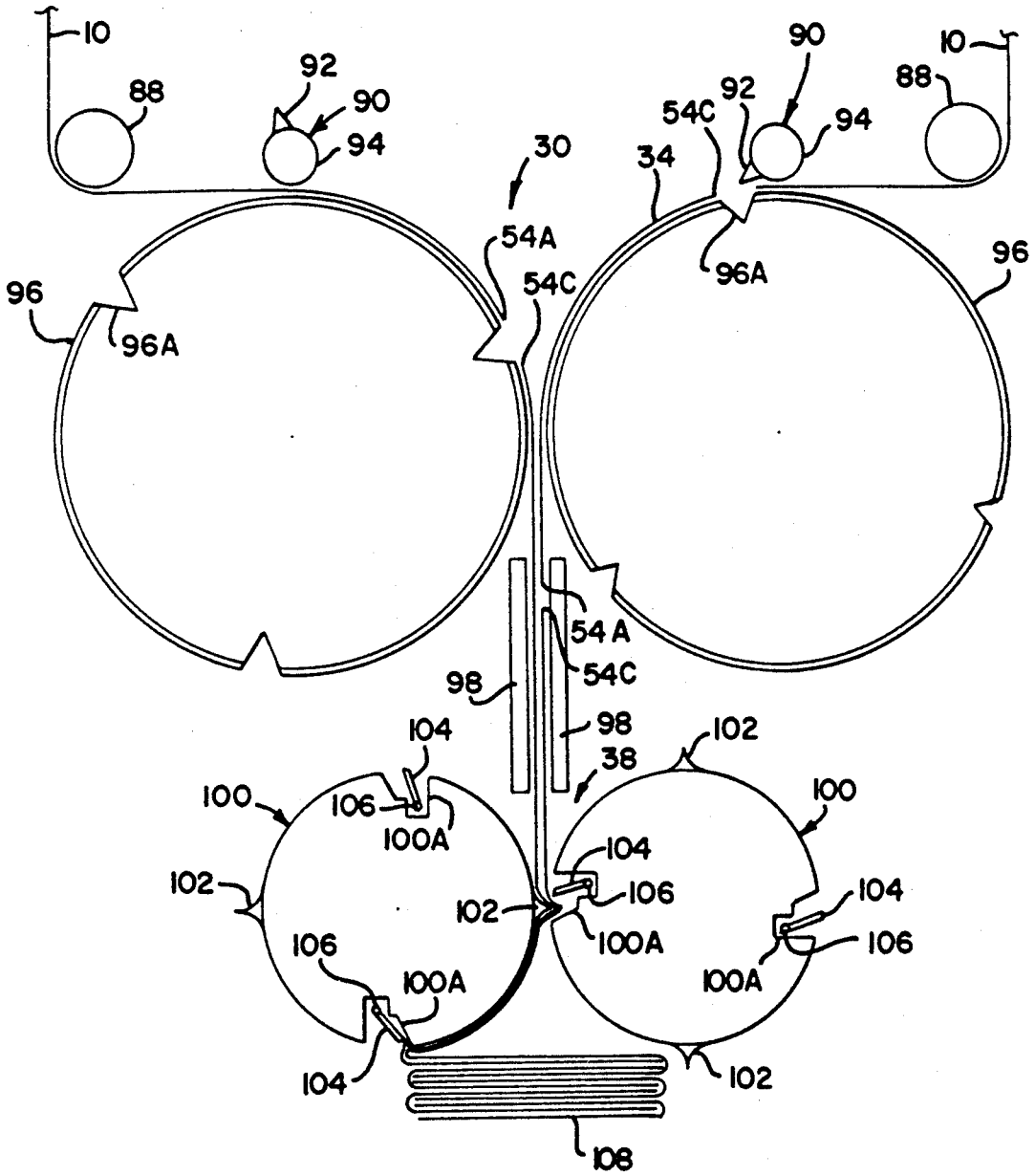
FIG. 5 is an enlarged partially diagrammatic view of the timed cut and seal station and interfolding station shown in FIG. 2.

The sheet material 10 next moves through the time cut and seal station 30 passing first over the idler rollers 88. At this stage it must be remembered that the sheet material 10 from each of the rolls 12 is moving in four lanes 20A, 26A, 26B and 20C (see FIG. 1). In the time cut and seal station 30, the lanes are cut to a specified length which forms the width of the bag 48. This operation is accomplished by rotating hot knife cut off and seal devices 90 which include a hot cutting blade 92 heated by conventional means (not shown) and carried by a rotating shaft 94, the rotation of which is timed by a camming device or other conventional mechanism (not shown) so that the hot cutting blade 92 will cut the moving lanes of plastic sheet material at the proper time to form the bags as shown in FIG. 1. This can be seen more clearly in FIG. 5. The hot knife cut off and seal device 90 operates against a vacuum roller 96 having a perforated surface. The vacuum roller 96 is timed to rotate in conjunction with the hot knife cut off and seal device 90 so that the cutting blade 92 will depress into a triangular indentation 96A in the vacuum roller 96 when it is to make its cut. This allows the knife 92 to not only cut the moving plastic lanes but to seal them to create the discrete bags as shown in FIG. 1. As shown in FIG. 5, the sheet material 10 from each roll 12 passes over a respective roller 96 and through a space between the two rollers 96 where the two sheets of material 10 are adjacent one another. The first and second rollers 96 are oriented and timed relative to one another such that the discrete bags 34A, 34B, 34C, and 34D created by the interaction of one hot cut off knife and seal device 90 with the first roller 60 will have their newly sealed ends located midway between the newly sealed ends of the discrete bags 34A, 34B, 34C, and 34D created by the interaction of the second hot cut off knife and seal device 90 and the second roller 60 in a staggered relationship. The vacuum rollers 96 also provide a source of vacuum which holds the now cut bags 34A, 34B, 34C, and 34D to the surface of the rollers 96 through apertures (not shown). The bags are held in contact with the rollers 96 until they are moved into the interfolding station which then takes them off of the rollers 96.

As the bags 34 leave the vacuum rollers 96 of the time cut and seal station, they pass through a pair of positioning plates 98 which through a slight air pressure holds them in the proper relationship as they move toward the interfolding station 38.

Referring now to the interfolding station 38, it includes a pair of rotating drums 100. The rotation of the drums 100 is timed to coincide with the rotation of the hot knife 90 and the vacuum rollers 96. Located on the surface of the rotating drums 100 are a pair of diametrically opposed tucker fingers 102 and indented within a part of recesses 100A in the surface of the rotating drums 100 are a pair of diametrically opposed gripper fingers 104 positioned 90° from the tucker fingers 102. The gripper fingers 104 are designed to rotate about an axle 106 which drives them in timing with the rotating drums 100, vacuum rollers 96, and hot knife 90. Timing of the various elements of the interfolding bag device may be accomplished by cams or by computer input which is conventional in the art. As the bags 34 leave the vacuum rollers 96, they pass through the positioning or guide plates 98 and are tucked by the tucker finger 102 into the indentation 100A in the rotating drum 100 such that the trailing edge of the preceding bag and the leading edge of the succeeding bag, which are formed from one roll 12 of tubular stock 10, are tucked into the middle of a bag formed from the other roll 12 of tubular stock material 10. A first gripper finger 104 then grabs the plastic bags and holds them to the surface of the rotating drum 100 until the drum has rotated 45° to bring the next tucker finger 102 into operation. This tucks the succeeding bags into the next aperture 100A to be gripped by the next gripper finger 104, at which time the preceding bags are being released by the first tucker finger 104. Each bag formed from one sheet of stock material 10 is thereby interfolded with a preceding and a succeeding bag from the other sheet of stock material 10 in a staggered relationship as shown in FIG. 5 to provide the interfolded bag arrangement 108.

The operation of the interfolded bag making device moves at considerable speed so that the interfolded bag pile 108 is rapidly moved along and stacked to an automatically preset and specified count after which it is put into the dispensing box 46.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed is:

1. A device for making interfolded boxed bags comprising:

means for feeding a source of first plastic sheet material into said device;

means for feeding a source of second plastic sheet material into said device;

means for moving said first and second sheet material through said device;

first means for cutting and sealing said first sheet material into a first series of discrete plastic bags;

second means for cutting and sealing said second sheet material into a second series of discrete plastic bags, said bags of said second series of bags being staggered relative to said bags of said first series of bags, each said bag in said first and second series of bags including a leading edge and a trailing edge;

first means for selectively holding each bag of said first series of bags in a substantially flattened condition as said first series of bags move through said device;

second means for selectively holding each bag of said second series of bags in a substantially flattened condition as said second series of bags move through said device;

means for receiving said first and second series of said flattened bags in said staggered relationship; and means for interfolding said first series of bags with said second series of staggered bags to create a stack of interfolded bags adapted for insertion into a dispensing container.

2. The device of claim 1 wherein said first and second means for selectively holding each of said bags of said first and second series of bags comprise a first and a second roller, each said roller having vacuum means for holding said bags on the surface thereof, said first and second rollers being rotatable in opposite directions relative to one another.

3. The device of claim 2 wherein said first and second means for cutting and sealing said first and second sheet material into a first and second series of discrete plastic bags respectively comprise a hot knife positioned adjacent said vacuum roller, each said knife being rotatable in a timed fashion with relation to its corresponding roller to cut and seal said sheet material as it moves along the surface of said roller.

4. The device of claim 1 wherein said means for receiving said first and second series of said flattened bags and said means for interfolding the same comprise a pair of rotating drums each having on the surface thereof, a pair of tucker fingers located opposite each other and a pair of gripper fingers located opposite each other, said gripper fingers being located in indentations in the surface of said drum, said rotating drums rotating in timed fashion such that the tucker finger of one drum will insert into the indentation for the gripper finger on the other drum, so that as said first and second series of plastic bags move through the space between said drums, each said tucker finger will insert the trailing edge of a preceding bag and the leading edge of a trailing bag from one said series of bags into the midsection of a bag from said other series of bags and into said indentation where upon said gripper finger releasably grips said bags as said drum rotates.

5. A method for forming interfolded bags comprising the steps of:

providing a source of first sheet material;

providing a source of second sheet material;

cutting said first and second sheet material into lanes;

cutting said first sheet material in each said lane to a desired length;

cutting said second sheet material in each said lane to a desired length, said cut sheet material formed from said second sheet material being staggered in relation to said cut sheet material formed from said first sheet material;

sealing the edges of said cut first sheet material to form a first series of discrete open top bags;

sealing the edges of said cut second sheet material to form a second series of discrete open top bags; and interfolding said bags from said first series of bags and from said series of bags one into the other to create a stack of interfolded bags.

6. A device for making interfolded boxed bags comprising:

first means for feeding a source of first plastic sheet material into said device;

second means for feeding a source of second plastic sheet material into said device;

a first roller;

a first cutting and sealing knife positioned adjacent said first roller, said first roller and said first knife being rotatable in a timed fashion to cooperatively cut and seal said first sheet material into a first series of discrete bags;

first vacuum means for holding said first series of bags to the surface of said first roller;

a second roller disposed adjacent to said first roller;

a second cutting and sealing knife positioned adjacent said second roller, said second roller and said second knife being rotatable in a timed fashion to cooperatively cut and seal said second sheet material into a second series of discrete bags which are staggered in relation to said first series of bags, each said bag in said first and second series of bags including a leading edge and a trailing edge;

second vacuum means for holding said second series of bags to the surface of said second roller;

a first drum having a pair of tucker fingers located opposite each other and a pair of gripper fingers located opposite each other, said gripper fingers being located in indentations in the surface of said drum; and a second drum having a pair of tucker fingers located opposite each other and a pair of gripper fingers located opposite each other, said gripper fingers being located in indentations in the surface of said second drum, said first and second drums being rotatable in timed fashion such that the tucker finger of one drum will insert into the indentation for the gripper finger on the other drum, each said tucker finger inserting the trailing edge of a preceding bag and the ledging edge from a preceding bag from one of said series of bags into the midsection of a bag from said other series of bags and into said indentation whereupon said gripper finger will releasably grip said bags as said drum rotates.

* * * * *